US010961112B2

(12) United States Patent
Spinks et al.

(10) Patent No.: US 10,961,112 B2
(45) **Date of Patent: *Mar. 30, 2021**

(54) METHOD AND APPARATUS FOR THE PRODUCTION OF A POCKETED SPRING UNIT

(71) Applicant: Harrison Spinks Components Limited, Leeds (GB)

(72) Inventors: Simon Paul Spinks, Cawood (GB); David Clare, Barnsley (GB)

(73) Assignee: Harrison Spinks Components Limited, Leeds (GB)

( * ) Notice: Subject to any disclaimer, the term of this patent is extended or adjusted under 35 U.S.C. 154(b) by 12 days.

This patent is subject to a terminal disclaimer.

(21) Appl. No.: 16/201,317

(22) Filed: Nov. 27, 2018

(65) Prior Publication Data

US 2019/0144261 A1 May 16, 2019

Related U.S. Application Data

(63) Continuation of application No. 13/893,521, filed on May 14, 2013, now Pat. No. 10,167,186, which is a (Continued)

(30) Foreign Application Priority Data

Sep. 17, 2005 (GB) ..... 0519009

(51) Int. Cl.
*B68G 9/00* (2006.01)
*A47C 27/06* (2006.01)

(52) U.S. Cl.
CPC ..... *B68G 9/00* (2013.01); *A47C 27/064* (2013.01); *Y10T 29/49609* (2015.01); *Y10T 29/49613* (2015.01); *Y10T 29/53996* (2015.01)

(58) Field of Classification Search
CPC ..... B68G 9/00; A47C 27/064; B65B 9/02; B65B 35/40; B65B 35/405; B65B 63/02; (Continued)

(56) References Cited

U.S. PATENT DOCUMENTS 1,915,264 A * 6/1933 Schneider et al. ..... B68G 9/00 53/114
1,950,186 A * 3/1934 Lofman ..... B68G 9/00 53/114

(Continued)

FOREIGN PATENT DOCUMENTS

DE 2905537 A * 8/1980 ..... B68G 9/00
EP 0089789 A1 * 9/1983 ..... B68G 9/00

(Continued)

*Primary Examiner* — Stephen F. Gerrity
(74) *Attorney, Agent, or Firm* — Occhiuti & Rohlicek LLP

(57) ABSTRACT

Disclosed are methods, apparatus, devices, and other implementations, including a method for the production of a pocketed spring unit that includes compressing a plurality of springs, moving the springs to positions between upper and lower layers of fabric or other material, step-wise advancing the material and the springs in a spring unit output direction, and welding together the lengths of fabric or other material at each step-wise advancement to produce a pattern of welds in which are formed a plurality of discrete pockets, each containing a spring.

4 Claims, 4 Drawing Sheets

Related U.S. Application Data continuation of application No. 13/385,189, filed on Feb. 6, 2012, now abandoned, which is a continuation of application No. 12/930,664, filed on Jan. 13, 2011, now abandoned, which is a continuation of application No. 11/992,147, filed as application No. PCT/GB2006/003439 on Sep. 15, 2006, now Pat. No. 7,877,964.

(58) Field of Classification Search

CPC ..... B65B 63/022; B65B 63/026; Y10T 29/49609; Y10T 29/49613; Y10T 29/53996

USPC ..... 53/438, 439, 114, 529, 530; 29/91.1, 29/896.92

See application file for complete search history.

(56) References Cited

U.S. PATENT DOCUMENTS 3,429,767 A * 2/1969 Bronstien, Jr. et al. ..... B68G 9/00 156/165
3,449,190 A * 6/1969 Bronstien, Jr. et al. ..... B68G 9/00 156/250
3,462,779 A * 8/1969 Thompson ..... A47C 27/064 5/655.8
3,668,816 A * 6/1972 Thompson ..... B65B 9/093 53/418
4,413,659 A * 11/1983 Zangerle ..... B21F 33/04 140/3 CA
4,491,491 A * 1/1985 Stumpf ..... B26D 7/086 156/251
4,566,926 A * 1/1986 Stumpf ..... A47C 27/063 156/165
4,986,518 A * 1/1991 Stumpf ..... B68G 9/00 267/89
5,444,905 A * 8/1995 St. Clair ..... B21F 3/02 29/564.7
5,553,443 A * 9/1996 St. Clair et al. ..... B68G 9/00 53/450
5,572,853 A * 11/1996 St. Clair et al. ..... B68G 9/00 53/440
5,579,810 A * 12/1996 Ramsey et al. ..... B21F 27/16 140/3 CA
5,699,998 A * 12/1997 Zysman ..... B68G 9/00 267/189
5,740,597 A * 4/1998 Eto ..... B68G 9/00 29/33 E
6,021,627 A * 2/2000 Mossbeck et al. ..... B65B 63/02 29/896.92
6,049,959 A * 4/2000 Grondahl ..... B68G 9/00 29/91.1
6,101,697 A * 8/2000 Stumpf et al. ..... B68G 9/00 29/771
6,119,322 A * 9/2000 Eto ..... B21F 33/04 29/33 E
6,159,319 A * 12/2000 Mossbeck ..... A47C 27/064 156/182
6,170,807 B1 * 1/2001 Eto ..... A47C 27/062 267/103
6,260,331 B1 * 7/2001 Stumpf ..... B65B 9/067 53/114
6,574,811 B1 * 6/2003 Mossbeck ..... A47C 27/064 5/655.8
6,698,166 B2 * 3/2004 Zysman ..... B68G 9/00 53/550
6,834,477 B2 * 12/2004 De Santis et al. ..... B68G 9/00 53/114
6,922,895 B1 * 8/2005 Whitworth ..... B21F 33/04 29/33 F
7,877,964 B2 * 2/2011 Spinks et al. ..... B68G 9/00 53/438
10,167,186 B2 * 1/2019 Spinks et al. ..... B68G 9/00
2002/0124321 A1 * 9/2002 Wells ..... A47C 27/063 5/720
2003/0057617 A1 * 3/2003 Zysman ..... A47C 27/064 267/89
2004/0103618 A1 * 6/2004 De Santis et al. ..... B65B 9/073 53/438
2007/0130883 A1 * 6/2007 Takahashi et al. ..... A47C 23/0433 53/285
2009/0266032 A1 * 10/2009 Spinks et al. ..... B68G 9/00 53/438
2010/0011509 A1 * 1/2010 Stjerna et al. ..... A47C 27/064 5/720
2011/0099812 A1 * 5/2011 Spinks et al. ..... B68G 9/00 29/896.9
2012/0210676 A1 * 8/2012 Spinks et al. ..... B68G 9/00 53/438
2013/0247518 A1 * 9/2013 Spinks et al. ..... B68G 9/00 53/438
2018/0072559 A9 * 3/2018 Spinks et al. ..... B68G 9/00
2019/0144261 A1 * 5/2019 Spinks et al. ..... B68G 9/00 53/438

FOREIGN PATENT DOCUMENTS

EP 0624545 A1 * 11/1994 ..... B68G 9/00
EP 1067090 A1 * 1/2001 ..... B68G 9/00
FR 2751248 A1 * 1/1998 ..... B68G 9/00
GB 595887 A * 12/1947 ..... B68G 9/00
GB 2042467 A * 9/1980 ..... B68G 9/00
WO WO-2004020327 A1 * 3/2004 ..... B68G 9/00
WO WO-2007031774 A1 * 3/2007 ..... B68G 9/00

* cited by examiner

METHOD AND APPARATUS FOR THE PRODUCTION OF A POCKETED SPRING UNIT

CROSS REFERENCE TO RELATED APPLICATIONS

The present application is a continuation of U.S. application Ser. No. 13/893,521, now U.S. Pat. No. 10,167,186, which is a continuation of U.S. application Ser. No. 13/385,189, now abandoned, filed Feb. 6, 2012 which, in turn, was a continuation of U.S. application Ser. No. 12/930,664, now abandoned, filed Jan. 13, 2011 which, in turn, was a continuation application of U.S. Ser. No. 11/992,147, now U.S. Pat. No. 7,877,964, filed Mar. 17, 2008 which was a National Stage Application claiming the priority of PCT Application No. PCT/GB2006/003439 filed Sep. 15, 2006, which in turn, claims priority from Great Britain Application Serial No. 0519009.5, filed Sep. 17, 2005. Applicants claim the benefits of 35 U.S.C. § 120 as to the parent applications and the PCT application and priority under 35 U.S.C. § 119 as to the said Great Britain application, and the entire disclosures of all of the aforedescribed applications are incorporated herein by reference in their entireties.

This invention relates to pocketed spring units, and to a method and apparatus for forming such units.

There have been many prior proposals for forming pocketed spring units, but it is felt that such prior proposals have been overly complicated and costly to produce, and the present invention seeks to obviate these and other disadvantages of such prior proposals.

According to one aspect of the present invention, there is provided a method for the production of a pocketed spring unit comprising the steps of compressing and feeding a plurality of springs into troughs or castellations in opposed conveyor belts, moving said springs from said troughs or castellations to a position between upper and lower layers of fabric or other material, step-wise advancing said material and said springs in the direction of the output of the apparatus and welding together said lengths of fabric at each said step-wise advancement by a plurality of sequentially controlled welding anvils so as to form a plurality of discrete pockets each containing a spring.

The method may include the additional step of forming the springs immediately prior to the springs being compressed and fed into said troughs or castellations.

According to another aspect of the present invention, there is provided apparatus for forming a pocketed spring unit comprising means for compressing and feeding springs between opposed conveyor belts, means for moving said compressed springs from between said conveyor belts in the direction of the output of the apparatus to positions between upper and lower lengths of fabric or other material, means for sequentially advancing said lengths and said springs in said direction, and welding means for sequentially welding together said lengths so as to form a plurality of discrete pockets each containing a spring.

Preferably, said springs will be fed to the positions between the opposed conveyor belts by means of an inserter mechanism, operation of said mechanism simultaneously compressing said spring.

The opposed conveyor belts will each consist of an endless castellated or troughed belt, and the means to feed the compressed springs from between the conveyor belts to positions between said lengths of fabric or other material will preferably be power-driven spring inserters having a plurality of arms adapted to enter and leave the castellations or troughs in said belts, said arms being greater in overall height than the height of the springs and making contact with said springs to move said springs between said layers.

The welding means will preferably be a plurality of movable welding anvils and a plurality of co-operating welding horns, said welding means being adapted to sequentially weld said layers together at each sequential movement of said layers and springs so as to form said discrete pockets.

The apparatus may include a spring coiler as an integral part of the apparatus, such coiler delivering the formed springs directly to the spring compressor and feeder means.

In order that the invention may be more readily understood, an embodiment thereof will now be described, by way of example only, reference being made to the accompanying drawings, wherein.

Figure 1:
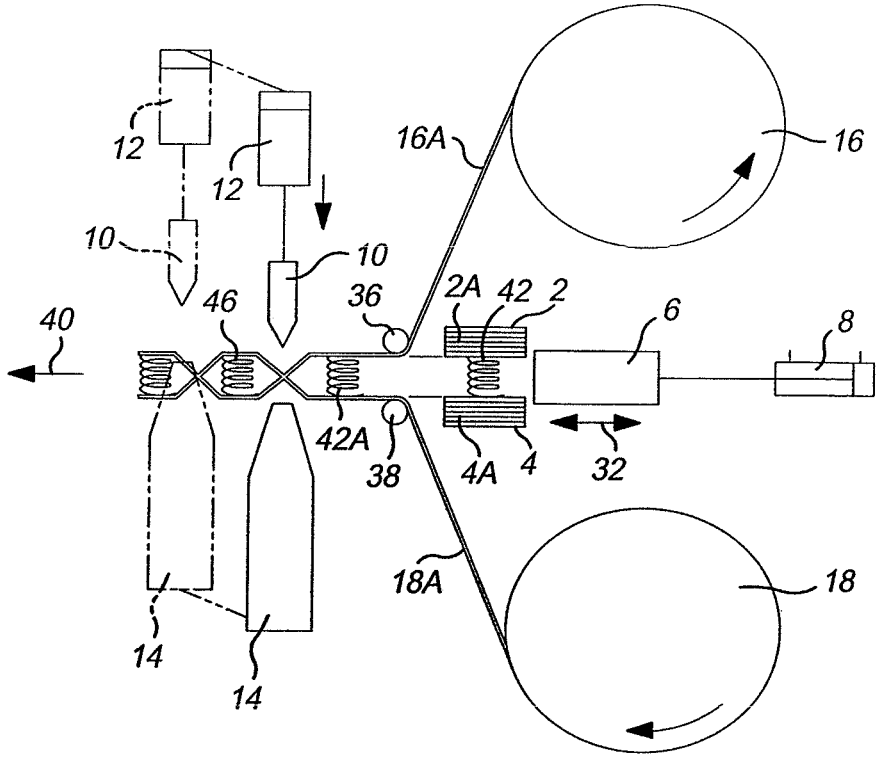
FIG. 1 is a schematic side view of apparatus in accordance with the invention.
Figure 2B:
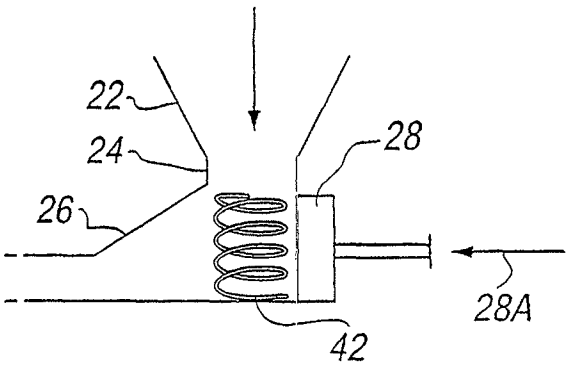
FIGS. 2A to 2D are schematic representations of a part of the apparatus of FIG. 1, and showing its sequence of operations.
Figure 2C:
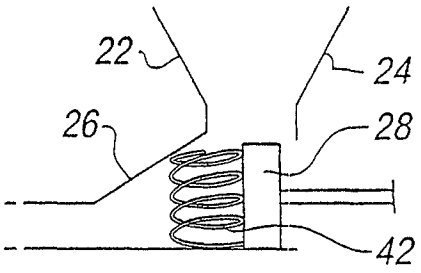
Figure 2D:
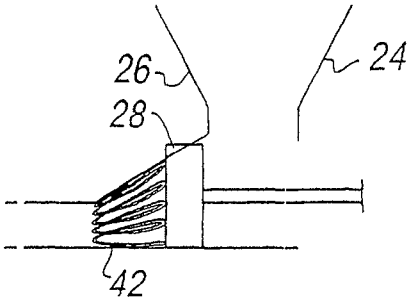
Figure 2A:
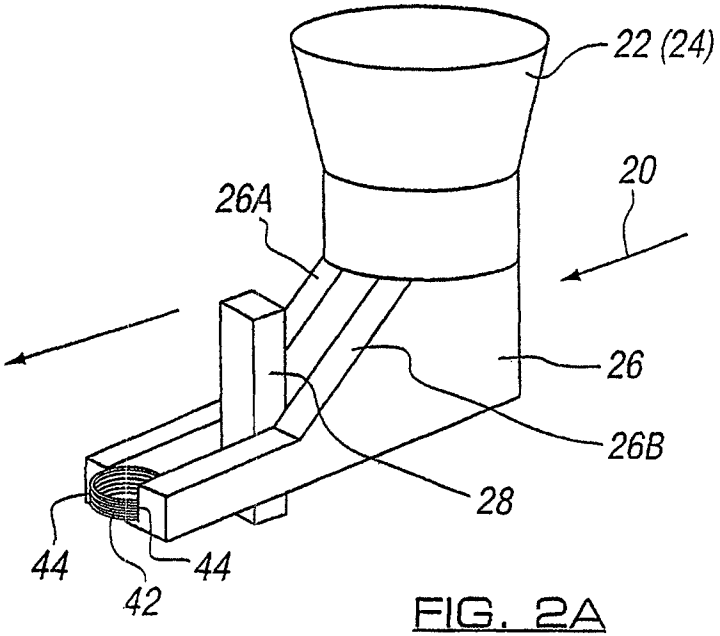

Referring to the drawings and firstly to FIG. 1, the apparatus for forming a spring unit comprises a spring compression and feeder, not shown in FIG. 1, but referenced 20 in FIG. 2A, spring delivery belts 2 and 4, spring inserters 6 and associated cylinders 8, a plurality of welding anvils, a plurality of air cylinders, and a plurality of welder horns, one each of these items being respectively referenced 10, 12, and 14. Rolls 16 and 18 of fabric or other material are shown associated with the apparatus.

Referring now to FIGS. 2A to 2D, the spring compressor 20 comprises a frusto-conical upper section 22, a straight-sided midsection 24, and a forwardly-sloping bifurcated lower section 26. Associated with the compressor 20 is a power-operated, preferably compressed air-operated, pusher and ejector plate 28.

Figure 3:
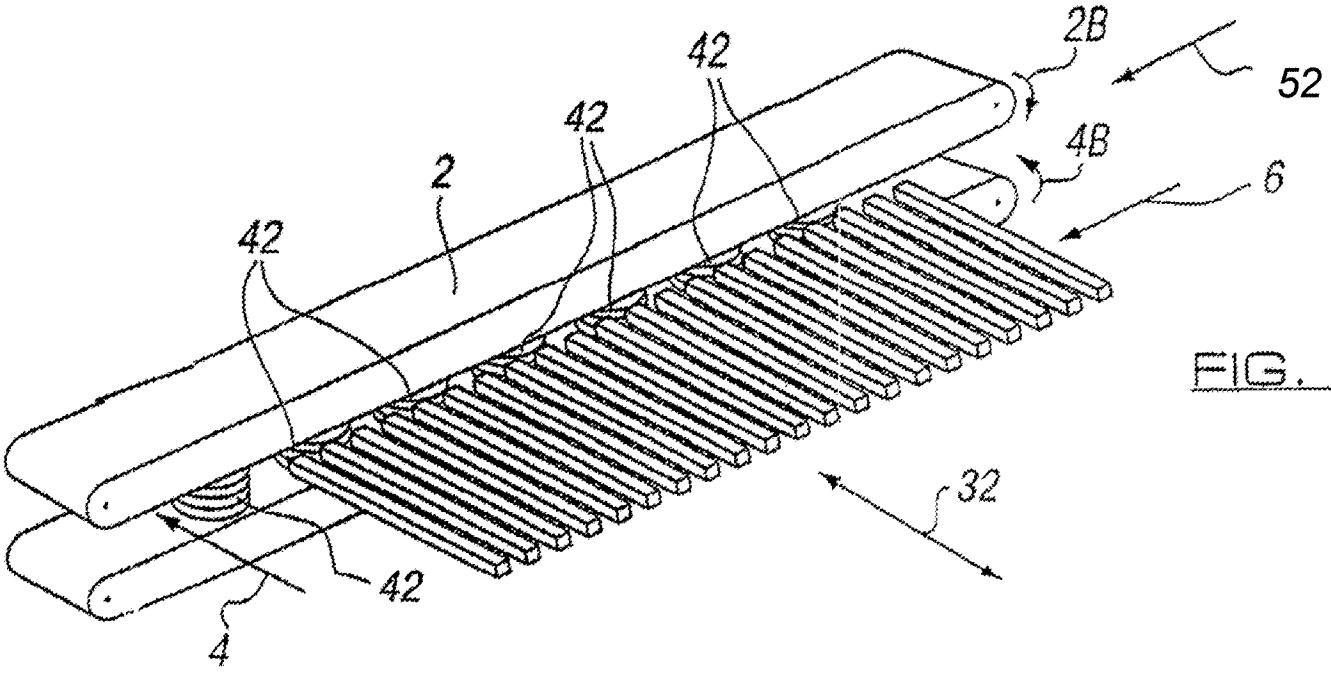
FIG. 3 is an enlarged perspective view of another part of the apparatus of FIG. 1.
Figure 4:
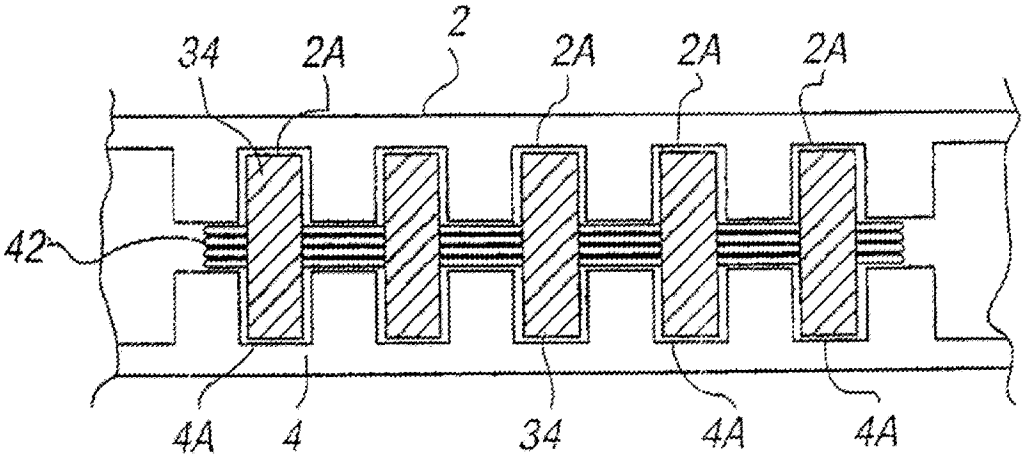
FIG. 4 is an enlarged view of a part of FIG. 3.

FIGS. 3 and 4 show the spring delivery belts 2 and 4, and the spring inserter 6 in detail. Each delivery belt 2 and 4 is endless and is castellated or troughed as indicated at 2A and 4A respectively. Each of the delivery belts is indexable so as to be movable in the direction of arrows 2B and 4B and is composed of any suitable material, but preferably a plastics material, and one or both of the delivery belts will be positively driven the delivery belts 2 and 4 are journalled in suitable frame members, not shown in the drawings.

Associated with the spring delivery belts 2 and 4 is the spring inserter 6 which is movable in the direction of arrow 32 by the air cylinders 8. The spring inserter 6 consists of a plurality of inserter arms 34 which are mounted on a suitable framework (not shown) which in turn is connected to the air cylinders 8 so as to enable said framework, and hence the inserter arms, to be moved in the directions of the arrow 32. There will preferably be a plurality of horizontally in-line spring inserters 6, each having a plurality of inserter arms 34, and in a preferred embodiment of the invention, there will be two inserters 6, each having three inserter arms 34, each inserter 6 being movable by an air cylinder 8. These spring inserters 6 will preferably be linked so as to move in unison.

As clearly shown in FIG. 4, the inserter arms 34 of the spring inserters 6 will be of a depth and width such that they can pass into and out of the castellations or troughs 2A and 4A of the spring delivery belts 2 and 4 so as to enable the compressed springs to be fed between the layers of fabric or other material being fed from the roll 16 and 18 as will be hereinafter explained.

Figure 5:
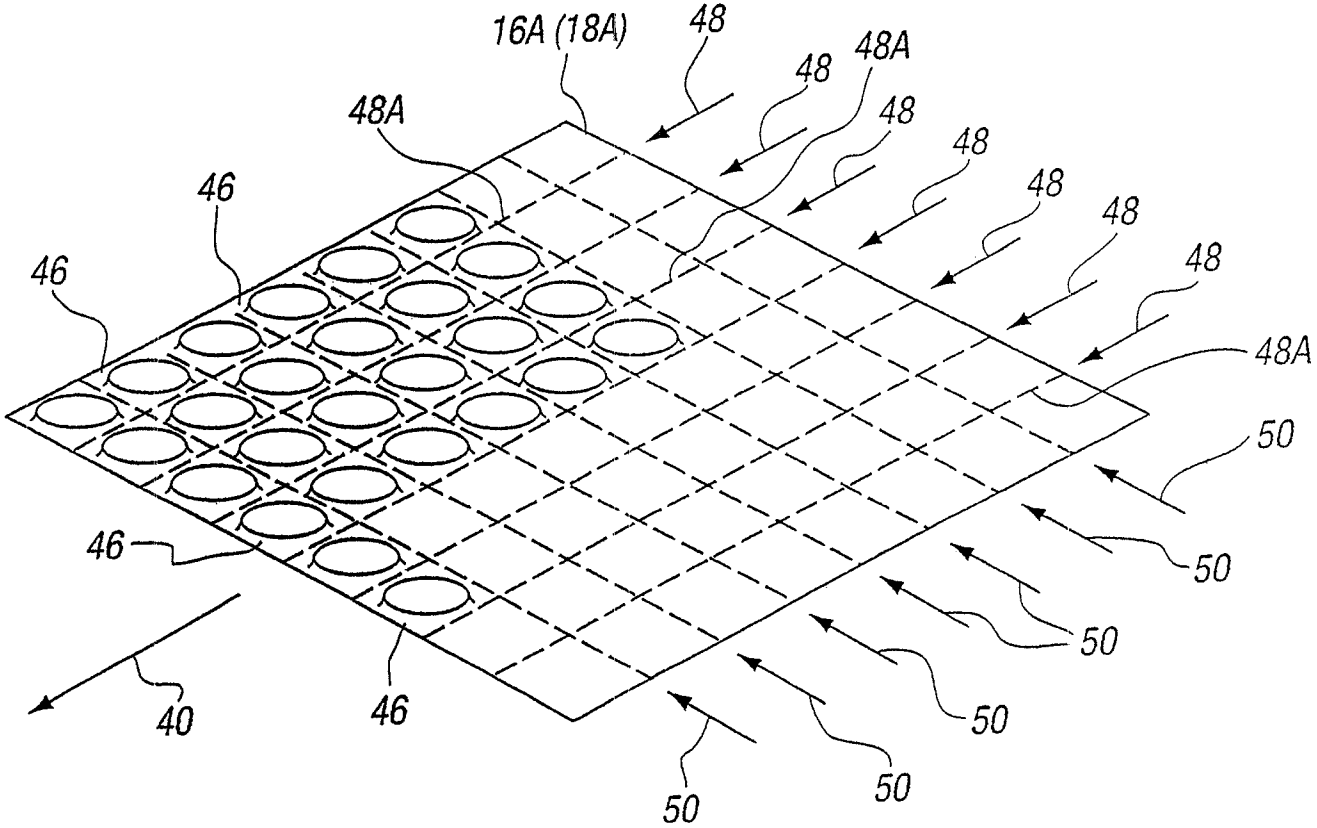
FIG. 5 is a schematic perspective view of a spring unit formed on the apparatus of FIG. 1.

The welding anvils 10 and their associated air cylinders 12 are operable, in conjunction with the welder horns 14, to work in a predetermined and pre-programmed manner so as to form a required pattern (as shown in FIG. 5) and entrap individual springs between the layers 16A and 18A of fabric or other material fed from the rolls 16 and 18. This will be explained in greater detail below.

Associated with the above-described apparatus is a spring coiler (not shown) which is adapted to form individual springs for delivery to the spring compressor 20. Such coiler may be an integral part of the apparatus previously described, or alternatively the springs may be pre-formed and delivered individually by suitable means to the spring compressor.

In operation, fabric or other material 16A and 18A is fed from the rolls 16 and 18 and passes around guide rollers 36 and 38 and continues to move in the direction of arrow 40, FIG. 1. As fabric or other material 16A and 18A continues to be fed from the rolls 16 and 18, individual springs 42 are located in the spring compressor and feeder 20 and contacted by the plate 28 which, moving in the direction of arrow 28A, moves the spring 42 towards and against the sloping section 26 so as to compress the spring axially as shown in FIG. 2D. Continued movement of the plate 28 between the bifurcations 26A and 26B moves the compressed spring into a slot 44 at the end of the spring compressor and feeder 20 and thence between the belts 2 and 4 at the proximal extremities thereof.

The compressed spring 42 moved by and between the belts 2 and 4 in the direction of arrow 52 (FIG. 3) towards the distal extremities of the belts. When a predetermined number of springs 42 are located in-line between the belts 2 and 4, the air cylinders 8 are actuated such that the spring inserters 6 move towards the belts and such that the inserter arms 34 move into the castellations or troughs 2A and 4A in the belts, resulting in the springs 42 passing between the rollers 36 and 38 to the positions 42A between the fabric or other material 16A and 18A.

When the row of springs 42 are at the position indicated by reference numeral 42A, the air cylinders 12 and hence the welding anvils 10 are actuated so as to entrap the springs in discrete pockets across the width of the fabric or other material, one of such pockets being 10 indicated by reference numeral 46 in FIG. 1.

In the formation of the discrete pockets, during which the springs are still in their compressed states, the multiple air cylinders control individual welding anvils to produce a grid pattern of welds which join the lengths of fabric or other material together, the welding anvils working in cooperation with the plurality of welder horns 14.

Reference to FIG. 5 will show the pattern of welds to form the discrete pockets 46. Each of the longitudinal welding lines indicated by reference numeral 48 is formed by a step movement of the lengths 16A and 18A of fabric or other material in the direction of the arrow 40 followed by a step welding process, selected welding anvils 10 being actuated every segment length 48A of the welding lines 48. In the described embodiment of the invention, each segment length is 16 mm, but it will be appreciated that such length may be changed. Each of the lateral welding lines 50 is produced by the step movement of the lengths 16A and 18A to the required positions followed by the actuation of all welding anvils, such actuation—in the embodiment of the invention being described—being every 75 mm, it again being appreciated that such distance may be changed.

Electronic control devices, not shown in the drawings, control the step movement of the lengths 16A and 18A of fabric or other material.

In addition, electronic control devices (not shown) control the compression and feeding of the springs between the conveyor belts 2 and 4, and the movement of the spring inserters 6 such that all the sequences of the apparatus is precisely controlled.

It will be appreciated that the spring compressor and feeder may differ from that shown in the drawings, and that the welding pattern may differ to that described. The chosen welding pattern, as regards its form and length of segments will be variable at will, and to some extent may well be determined by the type and nature of the springs being entrapped.

Thus the invention provides a method and apparatus for forming a pocketed spring unit for incorporation into an upholstered unit, the length and width of the pocketed spring unit being unlimited.

Finally, it will be appreciated that many variations may be made to the apparatus of the invention without departing from the spirit thereof, and it is intended that any such variations are encompassed herein.

The invention claimed is:

1. A method for the production of a pocketed spring unit comprising the steps of compressing a plurality of springs, moving said springs to positions between upper and lower layers of fabric or other material step-wise advancing said material and said springs in a spring unit output direction and welding together said lengths of fabric or other material at each step-wise advancement to produce a pattern of welds in which are formed a plurality of discrete pockets each containing a spring.

2. Apparatus for forming a pocketed spring unit comprising means for compressing springs, means for moving said compressed springs in a spring unit output direction to positions between upper and lower lengths of fabric or other material, means for sequentially advancing said lengths and said springs in said direction, and welding means for sequentially welding together said lengths to produce a pattern of welds in which are formed a plurality of discrete pockets each containing a spring.

3. Apparatus according to claim 2, wherein the means for moving the compressed springs to positions between said lengths of fabric or other material are power-driven spring inserters each having a plurality of arms, said arms being greater in overall height than the height of the springs and making contact with said springs to move said springs between said layers of fabric or other material.

4. Apparatus according to claim 2, wherein said welding means is a plurality of movable welding anvils and a plurality of co-operating welding horns, said welding means being adapted to sequentially weld said layers together at each sequential movement of said layers and said springs so as to form said discrete pockets.

* * * * *